US007168209B2

(12) United States Patent
Heidler, Jr.

(10) Patent No.: US 7,168,209 B2
(45) Date of Patent: Jan. 30, 2007

(54) ROOF WALL COPING SYSTEM AND METHOD

(75) Inventor: Charles W. Heidler, Jr., Lakewood, OH (US)

(73) Assignee: W.P. Hickman Systems, Inc., Solon, OH (US)

( * ) Notice: Subject to any disclaimer, the term of this patent is extended or adjusted under 35 U.S.C. 154(b) by 418 days.

(21) Appl. No.: 10/829,713

(22) Filed: Apr. 22, 2004

(65) Prior Publication Data

US 2005/0235578 A1 Oct. 27, 2005

(51) Int. Cl.
*E04D 13/14* (2006.01)
*E04H 12/00* (2006.01)
*E04G 21/00* (2006.01)

(52) U.S. Cl. ..... 52/60; 52/300; 52/741.4; 52/745.1

(58) Field of Classification Search ..... 52/300, 52/60, 94, 97, 466
See application file for complete search history.

(56) References Cited

U.S. PATENT DOCUMENTS 3,086,324 A * 4/1963 Cheney ..... 52/96
RE26,056 E 7/1966 Hickman
3,503,162 A 3/1970 Ward
3,533,201 A 10/1970 Tyler
3,624,973 A 12/1971 Attaway
4,483,112 A 11/1984 Rueblinger
4,550,535 A * 11/1985 Drogosch ..... 52/60
4,617,770 A * 10/1986 Hickman ..... 52/214
4,648,218 A * 3/1987 Butzen ..... 52/96
5,289,662 A * 3/1994 Castle ..... 52/287.1
5,893,247 A * 4/1999 Hickman et al. ..... 52/300
6,216,408 B1 * 4/2001 Davidson ..... 52/300
2003/0051428 A1 * 3/2003 Kay et al. ..... 52/566

* cited by examiner

*Primary Examiner*—Naoko Slack
*Assistant Examiner*—Elizabeth A Plummer
(74) *Attorney, Agent, or Firm*—Renner, Otto, Boisselle & Sklar, LLP

(57) ABSTRACT

A coping system includes a cleat mountable on a wall, a splice plate mountable over the cleat and a coping cap mountable to the cleat that is held in place by a spring between the cleat and the coping cap. In general, both the cleat and the coping cap have approximately U-shape cross-sections. The ends of the coping cap turn inwardly to form hooks that catch the ends of the cleat. The spring urges the coping cap to retain the legs of the cleat in the hooks and thus hold the coping cap to the cleat and to the wall. The splice plate is held in place on the cleat by clips that extend from the cleat and through corresponding openings in the splice plate to engage portions of the splice plate adjacent the openings, thereby preventing the splice plate from moving away from the cleat.

26 Claims, 4 Drawing Sheets

ROOF WALL COPING SYSTEM AND METHOD

FIELD OF INVENTION

The present invention relates generally to coping systems and, more particularly, to systems for coping roof walls.

BACKGROUND

The majority of roofing failures occur in two areas, at the edge of the roof at an exterior parapet wall and along interior walls that extend above the surface of the roof. The term "roof walls" refers to walls that extend above a roof surface, and includes both interior and exterior walls. If the top of the walls are not protected, water can penetrate the roof system and the interior of the building and cause damage. Therefore, properly protecting roof walls is essential to protecting against water damage.

Coping systems are used to cap and protect walls on building rooftops and to enhance the building's overall appearance. Coping systems typically include a cap that is installed along the top of the walls. The cap improves the appearance of the walls and increases the resistance of the roof walls to wind-driven rain. To withstand winds, systems have been developed to hold the coping cap to the roof wall. In traditional coping systems some of the elements are secured either to one another or the wall or both with fasteners that pass through one or more of the elements and remain exposed to the weather. These fasteners can promote unsightly corrosion and also can provide a pathway for water to pass through the coping system to the building.

One system employs a mounting plate secured to the wall and a cover mounted over it to cover the fasteners that hold the mounting plate to the wall. Both the mounting plate and the cover have U-shape cross-sections, with the ends of the mounting plate turned inwardly. A spring is placed between the cover and the mounting plate. These elements are designed so that the cover covers the mounting plate and the inwardly-turned portions of the cover can extend past the ends of the mounting plate before the spring biases those inwardly-turned portions against the ends of the mounting plate. The system components are thus held together and to a roof wall without requiring any fasteners to pass through the cover, thereby eliminating a potential source of corrosion and a pathway for water to penetrate the system.

It is also important to keep water way from the roof wall at seams between sections of the cover. To protect the seams many coping systems use sealants to seal the joints and keep water out of the system. The sealants must be applied carefully, are messy and time-consuming to use, and can fail over time and thus require periodic maintenance. Another system uses a drain plate under the seam to divert any water that does enter at the seam. Unfortunately, as temperature changes cause the cover to expand and contract, the drain plates can migrate away from the seams they are meant to protect.

SUMMARY OF INVENTION

The present invention provides a coping system that has few components, is easily installed, and leaves no exposed fasteners to provide a path for moisture transfer or unsightly corrosion. Moreover, this coping system minimizes or prevents longitudinal shifting of a splice plate under the coping cap to minimize or prevent water from penetrating the system through gaps between adjacent sections of the coping cap.

More particularly, the present invention provides a system that includes a cleat mountable to a roof wall, a coping cap mountable to the cleat, a spring element extendable between the coping cap and the cleat, and a splice plate mountable to the cleat under the coping cap. The cleat includes catches and distal ends of the coping cap have inwardly turned hooks that are adapted to receive the catches, whereby when the coping cap is mounted to the cleat the spring biases the hooks into engagement with the catches. The cleat and the splice plate further include cooperating elements that minimize movement of the splice plate relative to the cleat in at least one direction.

These cooperating elements include at least one protrusion and at least one corresponding hole, and in one embodiment the cleat includes at least one protruding clip that protrudes from a surface of the cleat and the splice plate includes at least one aperture for receiving the one or more clips. Each clip includes a portion spaced from a surface of the cleat for receipt of a portion of the splice plate between the spaced portion and the surface of the cleat. Thus, the clip can grip the splice plate between the protruding portion and an adjacent surface of the cleat.

The present invention also contemplates the combination of a cleat and a splice plate mountable on the cleat. The cleat has a width dimension that extends across a wall when mounted on a wall, and a length dimension transverse to the width dimension. When the cleat and the splice plate are mounted on a wall the cooperating elements minimize movement of the splice plate in a direction parallel to the length dimension.

In an exemplary embodiment of the invention, the coping system includes at least two cleats mounted at spaced locations on a roof wall, at least two coping caps mounted adjacent to each other and to at least two of the cleats, a splice plate mounted to each cleat, and a spring element between each coping cap and cleat. Each cleat has an approximately U-shape cross-section and a pair of legs extending from a central portion in a common direction, and at least one clip protruding from an outer side of at least one of the legs. The distal ends of the legs form catches. Each splice plate has an approximately U-shape cross-section and at least one opening in one leg to receive the clip of the cleat. A portion of the splice plate adjacent the opening is received in the clip, which minimizes movement of the splice plate relative to the cleat in a direction along the wall. Each coping cap has an approximately U-shape cross-section with a top portion and a pair of overhang portions extending in a common direction. The ends of the legs turn inwardly toward each other to form hooks that are adapted to receive the catches therein, whereby when each coping cap is mounted to respective cleats, the overhang portion of the coping cap extends over the legs of the cleat with the catches received in the hooks. The spring element then biases each coping cap away from the cleats and holds the catches in the hooks.

The coping cap is essentially "snapped" in place and allowed to expand and contract with temperature changes. Most existing coping systems require a sealant to seal the joint between adjacent sections. This system includes a draining splice plate that fits over the cleat and under the coping cap, and is particularly advantageous at seams between adjacent sections of the coping cap to catch penetrating water and drain it out of the coping system. The cleat has clips that hold the draining splice plate in place during installation and stop the splice plate from moving relative to the cleat, such as in a direction along the wall, as the coping cap expands and contracts with temperature changes. The splice plate is locked into the clips in the cleat.

The present invention also provides a method of mounting a coping system on a roof wall. An exemplary method includes the following steps: mounting at least one cleat to a roof wall, and mounting at least one splice plate to the cleat. The step of mounting the splice plate to the cleat includes moving the splice plate onto the cleat such that cooperating elements on the cleat and the splice plate move into engagement and thereby minimize movement of the splice plate relative to the cleat in a direction along the wall.

The method can also include mounting a coping cap to the cleat. The step of mounting the coping cap to the cleat includes the steps of pressing the coping cap downwardly over the cleat until a hook portion of the coping cap passes the distal end of a leg of the cleat, and releasing the coping cap. A spring element holds the coping cap in place and the cleat holds the splice plate in place.

The foregoing and other features of the invention are hereinafter fully described and particularly pointed out in the claims, the following description and annexed drawings setting forth in detail a certain illustrative embodiment of the invention, this embodiment being indicative, however, of but one of the various ways in which the principles of the invention may be employed.

DETAILED DESCRIPTION

Figure 1:
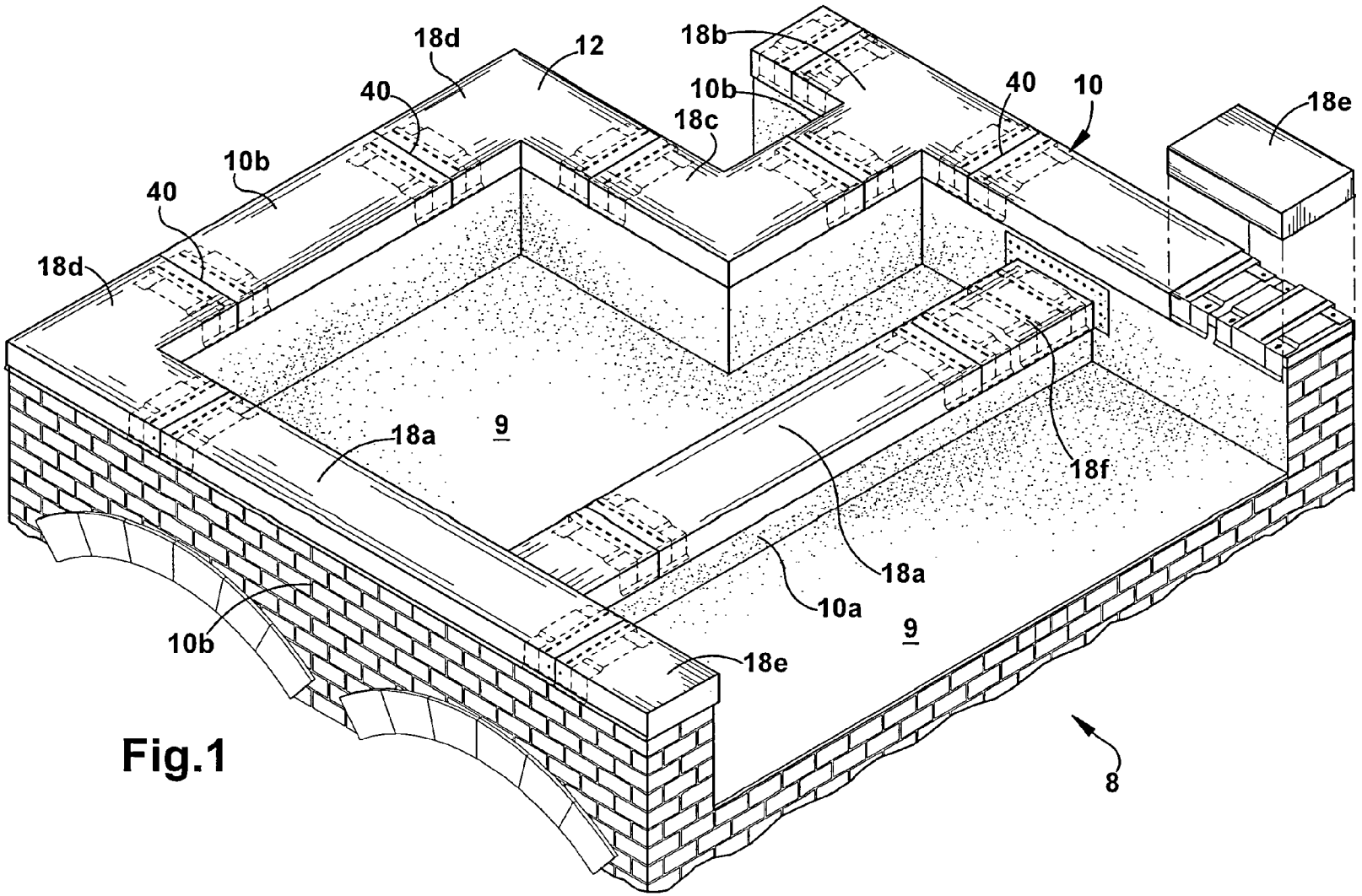
FIG. 1 is a perspective view of a roof wall coping system in accordance with the present invention.
Figure 2:
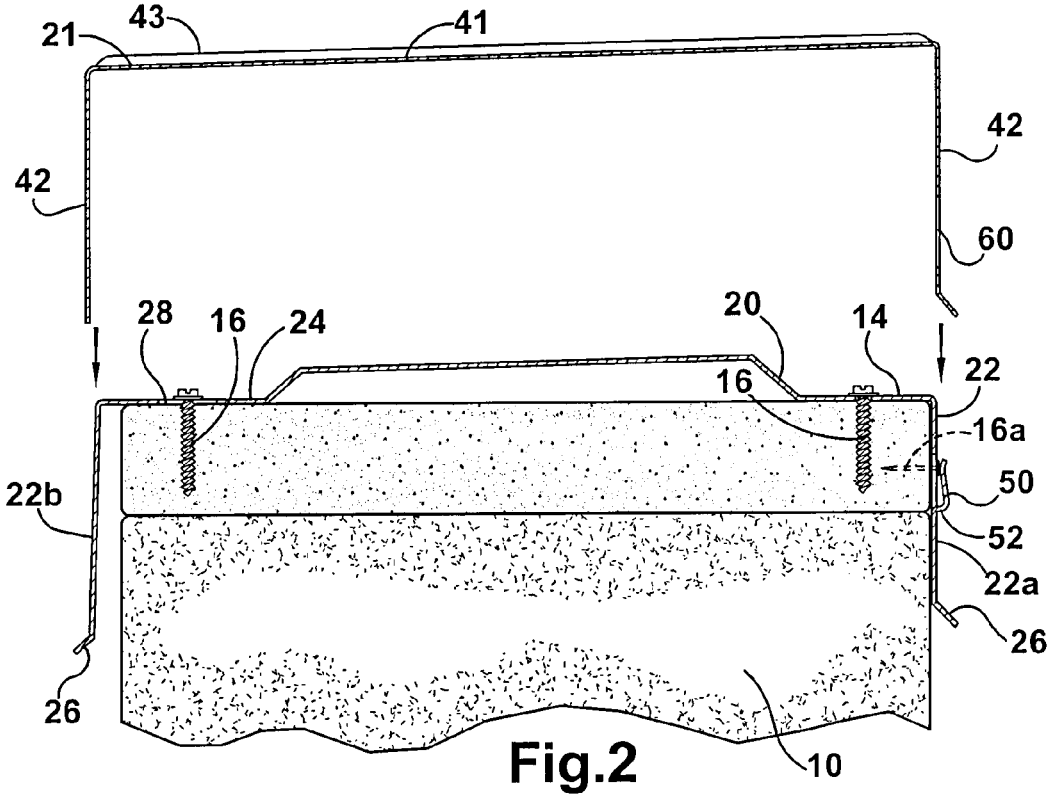
FIGS. 2–4 are sequential cross-sectional views of the roof wall coping system that illustrate assembly of the system.
Figure 3:
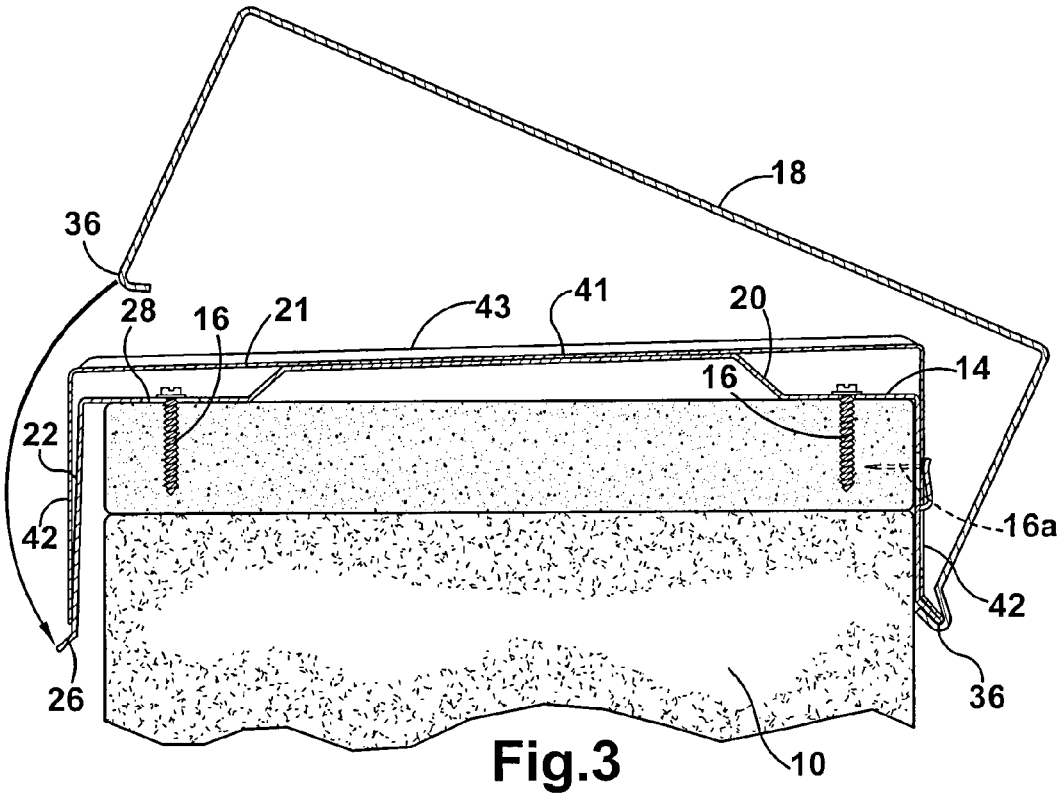
Figure 4:
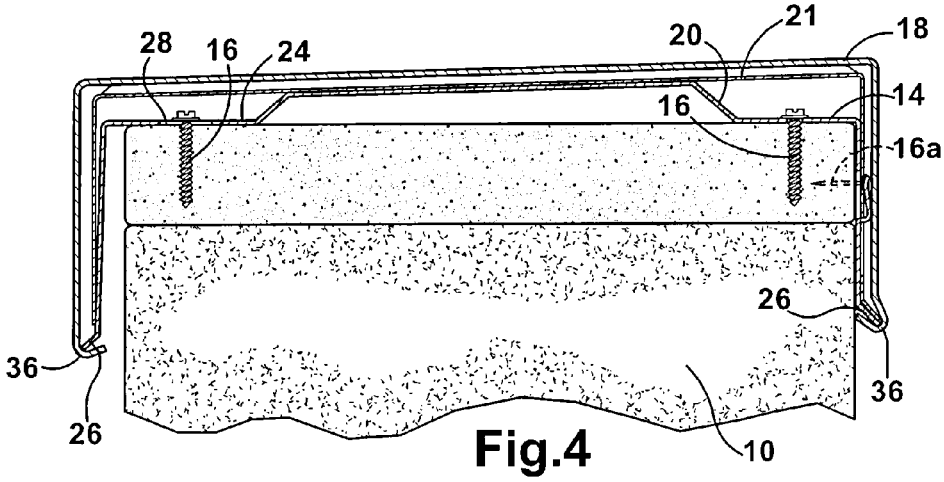
Figure 8:
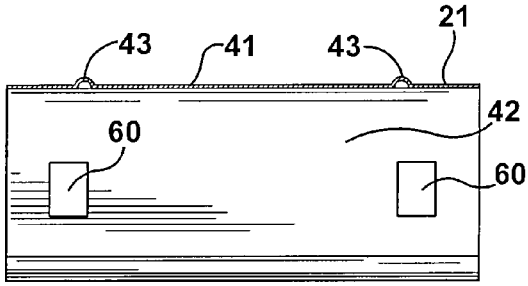
FIG. 8 is a cross-sectional view of a splice plate of the coping system as viewed along line 8—8 in FIG. 5.
Figure 5:
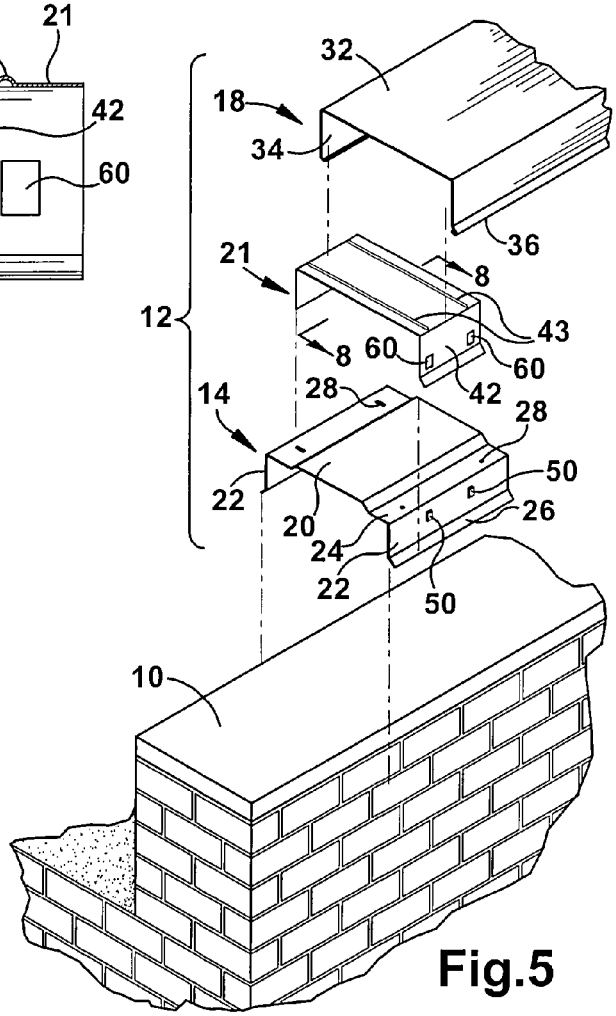
FIGS. 5–7 are sequential perspective views of the roof wall coping system invention that illustrate assembly of the system.
Figure 6:
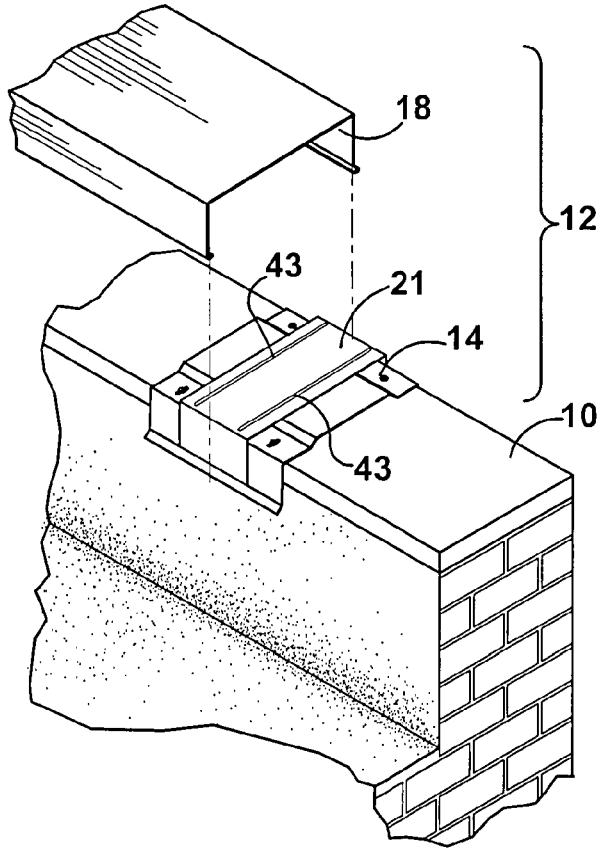
Figure 7:
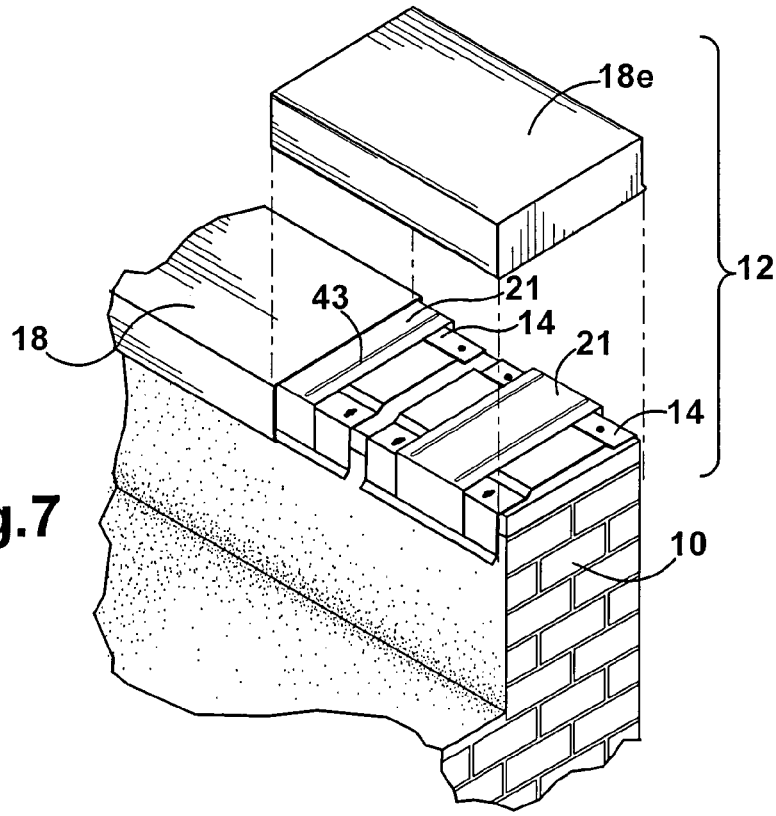

Referring initially to FIG. 1, a portion of a building 8 having a generally flat or low-slope roof 9 is shown. The illustrated building has both interior and exterior roof walls 10 protruding above the surface of the roof. The interior walls 10*a*, sometimes referred to as divider or short walls, typically form an upper portion of an interior wall of the building and have a roof surface on both sides of the wall. The exterior walls 10*b*, sometimes referred to as parapet walls, bound the periphery of the roof and protect the edge of the roof and generally only have a roof surface on an interior side of the wall.

The interior and exterior walls 10*a* and 10*b*, respectively, are exposed to the elements, and the present invention provides a coping system 12 that covers and protects the top of the roof walls and directs water impinging thereon away from the wall to minimize the opportunity for water to enter the building 8 through the wall itself or via the intersection of the wall and the surface of the roof 9. The term "water" includes all forms of water in the environment, such as water vapor, mist, fog, droplets, ice, and streams of water.

An exemplary coping system 12 is shown in FIGS. 2–7. The system 12 includes a cleat 14 mountable to a roof wall 10 with one or more fasteners 16 and a coping cap 18 that can be quickly and easily snapped onto the cleat 14 thereby covering the cleat 14, the fasteners 16, and the top of the wall. The cleat 14 and the coping cap 18 typically are made of sheet metal, although other materials can be used. The coping cap 18 can be formed in straight sections 18*a*, T-shape sections 18*b*, inside L-shape corner sections 18*c*, outside L-shape corner sections 18*d*, end cap sections 18*e*, and abutment sections 18*f*, for example, to cover various roof wall 10 configurations (see FIG. 1). The coping cap 18 seals the top of the wall, covers and protects the cleat 14 and the fasteners 16 and directs water away from the upper portion of the wall.

A spring element 20 holds the coping cap 18 to the cleat 14, and a splice plate 21 mounted between the cleat 14 and the coping cap 18 directs water away from seams between sections of the coping cap. Cooperating elements on the cleat 14 and the splice plate 21 keep the splice plate 21 from migrating away from the cleat, which is particularly important at the seams 40. Such cooperating elements can include protrusions and holes and combinations thereof on facing portions of the cleat and the splice plate. Cooperating portions of the coping cap 18 and the cleat 14 also make it easier to assemble and disassemble the coping system 12 provided by the present invention.

The illustrated cleat 14 has an approximately U-shape cross-section that roughly corresponds to the cross-sectional shape of the top of a wall. The legs 22 of the U-shape cross-section are spaced apart, are generally parallel, and extend in the same direction. A central portion 24, generally perpendicular to the legs 22, connects the legs to form a single unit. When installed, the central portion 24 typically spans the top of the wall and the legs 22 of the cleat typically extend down opposite sides of the wall. In the illustrated embodiment, the cleat 14 includes a first leg 22*a* and a second leg 22*b*. When the cleat 14 is mounted on a wall, the first leg 22*a* generally is positioned in an abutting relationship with the wall, typically an interior surface of the wall, and the second leg 22*b* is spaced from the wall if the wall is narrower than the central portion 24 of the cleat 14.

At least a portion of a distal end of at least one of the legs can extend outwardly, away from the central portion, and away from a wall to which the cleat is mounted. This helps to direct water away from the wall. In the illustrated embodiment, the distal ends of both legs 22 are bent outward.

The distal ends of the legs 22 also form catches 26 that engage the coping cap 18, as explained in the following paragraphs, to hold the coping cap 18 to the cleat 14. The central portion 24 of the cleat 14 generally includes one or more openings 28 through which the one or more fasteners 16 can be inserted to secure the cleat to the top surface of the wall. In the illustrated embodiment a fastener 16*a* also secures one leg 22*a* to the side of the wall. Suitable fasteners include nails, bolts, and screws, although an adhesive or cementious material may be used as fasteners in addition to or as an alternative to mechanical fasteners.

The openings 28 in the cleat 14 can include slots. The slots allow the cleat to be adjusted relative to the roof wall 10 and allow the cleat to move in a direction parallel to the length of the slots, typically perpendicular to the length of the wall, due to temperature changes, while also allowing the fasteners 16 to hold the cleat on the wall.

Like the cleat 14, the illustrated coping cap 18 also has an approximately U-shape cross-section that roughly corresponds to the cross-sectional shape of the top of a roof wall. The coping cap 18 has a top portion 32 and front and rear overhang portions 34 extending from the top in the same direction such that when installed the overhang portions extend down opposite sides of the wall. The top portion 32 of the coping cap 18 corresponds to the central portion 24 of the cleat 14, and the overhang portions 34 correspond to the legs 22 of the cleat 14. The respective parts of the coping cap and the cleat are called by different names only to help distinguish them in this description.

The distal ends of the overhang portions 34 of the coping cap 18 typically turn inwardly toward each other to form hooks 36 adapted to engage the catches 26 at the distal ends of the legs 22 of the cleat 14. The outside surface of the hooks also form drip edges to further facilitate directing water away from the wall. When installed on a wall, one overhang portion is typically positioned relatively close to a side of the wall and the distal end of that portion also extends outward to space the drip edge away from the wall.

The length of the coping cap generally is greater than the width, such that it can extend along the length of a roof wall 10 as shown in FIG. 1. The length of the coping cap usually is maximized (generally no more than about ten feet (about three meters)) to minimize the number of seams 40 (FIG. 1) between adjacent sections of the coping cap 18, since the seams provide potential pathways for water to penetrate the coping cap.

In contrast to the length of the coping cap 18, the length of the cleat 14 is typically relatively short, and generally has a length selected to permit it to engage the ends of both of two adjacent sections of the coping cap, for example. If additional attachment points are desired, for increased wind resistance, for example, a plurality of cleats 14 can be mounted at spaced intervals, such as about every five feet (approximately 150 cm), to hold intermediate portions of the coping cap 18 to the wall. The width of the coping cap and the cleat are typically related to a range of wall thicknesses with which they can be used.

After the coping cap 18 is placed over the cleat 14, the spring element 20 pushes the top 32 of the coping cap 18 away from the central portion 24 of cleat 14 and the wall to which the cleat is mounted. As a result, the coping cap 18 is spaced from the wall such that any moisture that gets past the coping cap is less likely either to reach or to damage the wall. In addition to the spacing provided by the spring element 20, by biasing the top 32 of the coping cap 18 away from the central portion 24 of cleat 14, the spring element 20 also holds the hooks 36 of the coping cap against the catches 26 formed by the distal ends of the legs 22 of the cleat 14. Thus the spring element 20 maintains the engagement of the catches 26 in the hooks 36 and holds the coping cap 18 to the cleat 14. Each of these components work together to hold the coping cap 18 on the wall and to prevent or minimize water entry while allowing for expansion and contraction of individual elements with changes in temperature.

In the illustrated embodiment, the spring element 20 is an integral part of the central portion 24 of the cleat 14. The spring element 20 is formed by a part of the central portion 24 of the cleat 14 that extends outward from the U-shape cross-section (upward and away from the wall when the cleat is installed) and away from the legs 22 and remainder of the central portion 24.

Although the spring element 20 is integrally formed in the cleat 14 in the illustrated embodiment, the spring element may be a separate component of the coping system 12, such as one or more compression springs. Additionally or alternatively, the spring element can be attached to or integrally formed in the coping cap. Moreover, other means for biasing the hooks 36 of the coping cap 18 against the catches 26 formed by the legs 22 of the cleat 14 can be used in addition to or as an alternative to the spring element 20 shown in the illustrated embodiment.

The illustrated embodiment further includes the splice plate 21, which also has an approximately U-shape cross-sectional geometry similar to the cleat 14 shown in FIGS. 2–8 and typically is made of sheet metal. Like the cleat 14, the splice plate 21 includes a central portion 41 interconnecting a pair of legs 42 extending therefrom. The splice plate 21 is removably mounted to the cleat 14 and helps block and drain any water that enters through the seams between the sections of the coping cap 18. Unlike the coping cap 18, however, the splice plate 21 also includes two or more spaced apart ribs 43 that extend from the central portion and space the splice plate from the coping cap. In the illustrated embodiment the splice plate has two parallel ribs 43 that generally extend perpendicular to the roof wall 10*a* or 10*b* (FIG. 1) and parallel to the seam 40 in the coping cap 18. The ribs 43 space adjacent surfaces of the splice plate 42 from the coping cap 18 to provide a drainage path for water that reaches the splice plate. The seam between adjacent sections of the coping cap preferably lies between the ribs of the splice plate. The ribs also help to prevent water from moving past the ribs and under the coping cap. Moreover, the central portion 41 of the splice plate 21 preferably is not perpendicular to the legs 42, but angled such that the central portion 41 is sloped along its width, from one side of the wall to the other, when mounted on a wall. This helps to drain any water that reaches the splice plate away from the wall.

Turning to the cooperating elements that minimize movement between the splice plate 21 and the cleat 14, for its part the illustrated cleat 14 includes one or more protrusions in the form of clips 50 on an outer surface of one or more legs 22 to engage the splice plate 21 and hold it there. The illustrated embodiment has two clips 50 stamped from one of the legs 22 of the cleat 14. The clips 50 protrude from adjacent surfaces of the cleat, and open upwardly to engage the splice plate 21 as it is pushed down over the cleat 14. A bottom side of the illustrated clip 50 protrudes from the surface of the cleat to form a shoulder 52 that tends to prevent the splice plate 21 from lifting up over the clip 50. The illustrated clip 50 also has a portion spaced from a surface of the cleat that has a curvature from bottom to top that helps the clip grip the splice plate 21 between the spaced portion and adjacent surfaces of the cleat. By virtue of the clips 50 protruding from the surface of the cleat 14, the clips 50 also prevent or limit movement of the splice plate 21 relative to the cleat 14 in a direction along the length of the wall, keeping the splice plate 21 from migrating out from under the seam between abutting sections of the coping cap 18, for example. Although the illustrated clips are formed integrally in the cleat, alternatively, clips can be separate items that can be attached to the cleat.

As for the corresponding elements of the splice plate 21, at least one of the legs 22 of the splice plate 21 has one or more holes in the form of openings 60 therethrough to receive the clips 50 of the cleat 14. The illustrated splice plate 21 includes a pair of squared-off openings 60 in one leg that are sized to receive respective clips 50 therethrough as the splice plate 21 is pushed down over the cleat 14, and then to engage the clips 50 with portions of the splice plate adjacent the openings 60. Once the splice plate 21 is mounted on the cleat 14, the clips 50 and the material bounding the openings 60 cooperate to minimize any movement of the splice plate 21 relative to the cleat 14. Thus, unlike prior systems where the splice plate was not so constrained and could migrate away from a seam between adjacent sections of the coping cap, the present invention provides a cleat and a splice plate that effectively keep the splice plate in its intended position even through many seasons of temperature changes and extreme weather that otherwise could dislodge the splice plate from the cleat.

Further, once a coping cap 18 is mounted over the cleat 14 and the splice plate 21, the splice plate is further constrained from lifting off the cleat by its position between the coping cap 18 and the cleat 14.

When installed, the splice plate 21 generally is substantially concealed beneath the junction of adjacent sections of the coping cap 18 and helps to direct water that enters the seam 40 away from the cleat 14 and the wall. The seam can form a gap between adjacent sections of the coping cap that can be about one-eighth to one quarter of an inch wide (about 0.3 to 0.6 cm) as a result of such movement. Since the coping cap 18 is held away from the wall itself, the splice plate 21 provides an additional barrier to prevent water penetration into the wall and also provides drainage out of the seam 40.

A method of mounting the coping system 12 on a roof wall 10 includes mounting one or more cleats 14 at positions spaced along the length of a wall 10, positioning splice plates 41 on the cleats 14 as necessary, and snapping one or more coping caps 18 onto the cleats.

The cleats 14 generally are installed at spaced intervals across the top surface of the wall 10, at least at intervals corresponding to the selected length of coping cap 18 to be used. Cleats also can be mounted at intermediate positions to further secure the coping cap 18 to the wall. The cleats 14 are mounted to the wall with one or more fasteners 16 inserted through the openings 28 in the central portion 24 of the cleat 14. The cleat 14 generally is oriented on the wall such that a fastener 16 also can be used to hold one side of the cleat against the wall. By placing one leg 22*a* of the cleat 14 against the wall 10, the opposite leg 22*b* of the cleat generally will be spaced from an opposite side of the wall, depending on the thickness of the wall.

Next, the splice plate 21 is pushed downwardly over the cleat 14 where two sections of the coping cap 18 will meet such that the clips pass through the openings 60 in the splice plate 21 to engage the splice plate and hold it in its position relative to the cleat 14. A splice plate 21 can be mounted over all of the cleats 14, even cleats that are not at an intersection between two sections of the coping cap, if desired (see FIG. 7, for example).

Finally, the coping cap 18 is installed by first engaging one of the hooks 36 with one or more of the catches 26 formed at the distal ends of the legs 22 of the at least one, and usually at least two, cleats 14. The coping cap 18 is rotated over the cleat 14, and pressed down, depressing the spring element 20, until the end of the hook 36 on the opposite side of the coping cap 18 passes the respective catches 26 on the other side of the one or more cleats 14. When the coping cap 18 is released, the spring element 20 pushes the coping cap 18 upwardly, thereby engaging the catches 26 in the hooks 36 and holding the coping cap 18 to the cleat 14. Thus, the spring element 20 must be sufficiently compressible to allow the end of the hook 36 to pass the distal end of the leg of the cleat 14, but also must provide sufficient biasing force to keep the catches 26 at the ends of the legs 22 within the hooks 36.

The system also is easily disassembled by reversing the steps described above.

As the foregoing description and accompanying drawings have attempted to make clear, the present invention provides a coping system that provides significant advantages: the coping system is relatively simple and inexpensive to manufacture, is easily installed, and yet provides improved protection for roof walls. This protection includes protection of the fasteners that are used to secure the coping system to the wall, thereby enhancing the appearance of the coping system as well as its durability. This protection also includes improved splice plates and cleats that resist moving apart so that the splice plate will stay in position beneath a seam at the junction between adjacent sections of the coping cap.

Although the invention has been shown and described with respect to an illustrated embodiment, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the herein illustrated embodiments of the invention.

What is claimed is:

1. A system, comprising: a cleat mountable to a roof wall, a coping cap mountable to the cleat, a spring element extendable between the coping cap and the cleat, and a splice plate mountable to the cleat under the coping cap, the cleat including catches and distal ends of the coping cap having inwardly turned hooks that are adapted to receive the catches, whereby when the coping cap is mounted to the cleat the spring biases the hooks into engagement with the catches, and the cleat and the splice plate further including cooperating elements that minimize movement of the splice plate relative to the cleat in at least one direction, wherein the cooperating elements include at least one protrusion and at least one corresponding hole that minimize the movement of the splice plate relative to the cleat in at least one direction.

2. A system as set forth in claim 1, wherein the cleat includes at least one protruding clip that protrudes from a surface of the cleat and the splice plate includes at least one opening for receiving the at least one clip.

3. A system as set forth in claim 2, wherein the clip is integrally formed in the cleat.

4. A system as set forth in claim 2, wherein the clip includes a portion spaced from a surface of the cleat for receipt of a portion of the splice plate between the spaced portion and adjacent surfaces of the cleat.

5. A system as set forth in claim 2, wherein the clip has a portion that protrudes from the surface of the cleat relative to an adjacent surface of the cleat for gripping the splice plate between the protruding portion and an adjacent surface of the cleat.

6. A system as set forth in claim 1, wherein the cleat has a generally U-shape cross-section with a central portion having a width dimension for spanning a top of the roof wall and a pair of legs extending from the central portion in a common direction, the distal ends of the legs forming the catches, the coping cap having a generally U-shape cross-section with a top and a pair of overhang portions extending in a common direction, the ends of the legs turning inwardly toward each other to form the hooks, whereby when the coping cap is mounted to the cleat, the overhang portions of the coping cap extend over the legs of the cleat with the catches received in the hooks.

7. A system as set forth in claim 6, wherein the distal end of at least one of the legs is inclined outwardly, away from the opposing leg.

8. A system as set forth in claim 6, wherein the spring element extends from the central portion of the cleat.

9. A system as set forth in claim 6, wherein the spring element is an integral part of the cleat.

10. A system as set forth in claim 6, wherein the cleat has at least one opening in the central portion for mounting the cleat to the wall with at least one fastener.

11. A system as set forth in claim 6, wherein at least one fastener connects the central portion of the cleat to the wall and at least one other fastener connects at least one of the legs of the cleat to the wall.

12. A system as set forth in claim 6, further comprising a plurality of cleats to which a coping cap is mountable.

13. A system as set forth in claim 6, further comprising a plurality of cleats to which a plurality of sections of coping cap are mountable.

14. A system as set forth in claim 6, wherein the cleat is made of a sheet material.

15. A system as set forth in claim 6, wherein the cleat is made of sheet metal.

16. In combination, a cleat and a splice plate mountable on the cleat, the cleat having a width dimension that extends across a wall when mounted on a wall, and a length dimension transverse to the width dimension, wherein the cleat includes at least one protruding clip that protrudes from a surface of the cleat and the splice plate includes at least one aperture for receiving the at least one clip that cooperate to minimize movement of the splice plate in a direction parallel to the length dimension.

17. A combination as set forth in claim 16, wherein the clip includes a portion spaced from a surface of the cleat for receipt of a portion of the splice plate between the spaced portion and the surface of the cleat.

18. A combination as set forth in claim 16, wherein the clip has a portion that protrudes from an adjacent surface of the cleat for gripping the splice plate between the protruding portion and an adjacent surface of the cleat.

19. A method, comprising the following steps:

mounting at least one cleat to a roof wall; mounting at least one splice plate to the cleat; providing a cleat having a clip protruding therefrom and a splice plate having an opening; and mounting the splice plate on the cleat, including moving the splice plate to receive the clip through the aperture and engaging a portion of the splice plate adjacent the opening in the clip; wherein the step of mounting the splice plate to the cleat includes moving the splice plate onto the cleat such that cooperating elements on the cleat and the splice plate move into engagement and thereby minimize movement of the splice plate relative to the cleat in a direction along the wall.

20. A method as set forth in claim 19, further comprising the step of mounting at least one coping cap to the at least one cleat.

21. A method as set forth in claim 20, wherein the step of mounting the coping cap to the cleat includes pressing the coping cap downwardly over the cleat until a hook portion of the coping cap passes the distal end of a leg of the cleat, and releasing the coping cap.

22. A method as set forth in claim 21, further comprising providing a spring element between the central portion of the cleat and the top of the coping cap, the spring element acting on the coping cap to bias the distal ends of the legs into engagement with the hooks of the coping cap.

23. A method as set forth in claim 20, wherein the step of mounting the coping cap to the cleat includes hooking one of the hooks over a distal end of a respective leg, and rotating the coping cap over the cleat.

24. A method as set forth in claim 19, further comprising providing a cleat having a central portion and a pair of legs extending from the central portion in a common direction.

25. A method as set forth in claim 19, further comprising providing a coping cap having a pair of overhang portions extending from a top portion in a common direction, the distal ends of the overhang portions having an inwardly turned hook adapted to receive respective distal ends of the respective legs of the cleat.

26. A coping system, comprising: at least two cleats mounted at spaced locations on a roof wall, at least two coping caps mounted adjacent to each other and to at least two of the cleats, a splice plate mounted to each cleat, and a spring element between each coping cap and cleat, each cleat having an approximately U-shape cross-section and a pair of legs extending from the central portion in a common direction, at least one clip protruding from an outer side of at least one of the legs, the distal ends of the legs forming catches, each splice plate having an approximately U-shape cross-section and at least one opening in one leg to receive the clip of the cleat so that a portion of the splice plate adjacent the opening is received in the clip, which minimizes movement of the splice plate relative to the cleat in a direction along the wall, each coping cap having an approximately U-shape cross-section with a top portion and a pair of overhang portions extending in a common direction, the ends of the legs turning inwardly toward each other to form hooks that are adapted to receive the catches therein, whereby when each coping cap is mounted to respective cleats, the overhang portion of the coping cap extends over the legs of the cleat with the catches received in the hooks, and the spring element biases each coping cap away from the cleats and holds the catches in the hooks.

* * * * *